United States Patent [19]

Takauji

[11] Patent Number: 4,813,328

[45] Date of Patent: Mar. 21, 1989

[54] FORMANT FILTER GENERATOR FOR AN ELECTRONIC MUSICAL INSTRUMENT

[75] Inventor: Kiyomi Takauji, Shizuoka, Japan

[73] Assignee: Kabushiki Kaisha Kawai Gakki, Seisakusho, Japan

[21] Appl. No.: 67,446

[22] Filed: Jun. 26, 1987

[30] Foreign Application Priority Data

Sep. 2, 1986 [JP] Japan ..... 61-206491

[51] Int. Cl.[4] ..... G10H 1/12

[52] U.S. Cl. ..... 84/1.19; 364/419; 364/724.01; 84/1.1; 84/DIG. 9

[58] Field of Search ..... 84/1.1–1.13, 84/1.19–1.27, DIG. 9; 364/419, 724

[56] References Cited

U.S. PATENT DOCUMENTS

| | | | |
|---|---|---|---|
| Re. 31,653 | 8/1984 | Takeuchi | 84/1.21 |
| 4,077,294 | 3/1978 | Hiyoshi et al. | 84/1.23 |
| 4,114,497 | 9/1978 | Hiyoshi et al. | 84/1.19 X |
| 4,176,577 | 12/1979 | Yamada et al. | 84/1.19 X |
| 4,256,004 | 3/1981 | Takeuchi | 84/1.22 X |
| 4,628,785 | 12/1986 | Buchla | 84/1.1 |
| 4,700,603 | 10/1987 | Takauji et al. | 84/1.19 |

*Primary Examiner*—Stanley J. Witkowski
*Attorney, Agent, or Firm*—McGlew and Tuttle

[57] ABSTRACT

In the production of a desired musical waveform by combining harmonic components corresponding to respective harmonic orders, each harmonic component value is controlled by a selected cut-off harmonic order qc, level Ha and slope of the formant filter characteristic. The cut-off harmonic order qc, the level Ha and the slope values can each be varied over a predetermined range. Therefore, the slope values of the formant filter characteristic are interpolated to raise resolution, by which it is possible to prevent an abrupt change in the formant filter characteristic and suppress the generation of noise.

8 Claims, 8 Drawing Sheets

105

FORMANT FILTER GENERATOR FOR AN ELECTRONIC MUSICAL INSTRUMENT

BACKGROUND OF THE INVENTION

1. Field of the Invention

The present invention relates to an electronic musical instrument which permits easy control of harmonic coefficients in the production of a desired musical waveform by combining harmonic components while at the same time effecting level control of the respective harmonic coefficients.

2. Cross-Reference to Related Application

The present invention is related to prior art U. S. patent application Ser. No. 847,426 which matured into U.S. Pat. No. 4,700,603 on Oct. 20, 1987, entitled "Formant Filter Generator for an Electronic Musical Instrument" and assigned to the same assignee as in the subject application.

3. Description of Prior U.S. application Ser. No. 847,426 now U.S. Pat. No. 4,700,603

In the above-noted application an electronic musical instrument was proposed utilizing, in combination, a memory system and a calculation system, by which it is possible to create a format filter characteristic which enables easy control of respective harmonic coefficients through use of a simple circuit arrangement. This electronic musical instrument combines harmonic components corresponding to respective harmonic orders into the desired musical waveform having a formant filter characteristic with a harmonic order q, a cut-off harmonic order $q_c$ which is below or above the harmonic order, a level Ha, and a slope SL. The electronic musical instrument is provided with means for generating the cut-of harmonic order $q_c$ of the formant filter characteristic, means for generating the level Ha of the formant filter characteristic, memory means for storing the slope SL of the formant filter characteristic, and select means for selecting one of the level Ha from the level generating means and the slope SL from the memory means in accordance with the cut-off harmonic order $q_c$ from the cut-off harmonic order generating means. Each harmonic component value is controlled with the output signal from the selecting means.

FIGS. 3A and 3B are a block diagram illustrating the arrangement of the electronic musical instrument disclosed in the above-mentioned U.S. application. In FIGS. 3A and 3B a musical tone generating system 100 produces a desired musical tone through use of an ordinary Fourier synthesis system.

A key tablet assignor 102 scans a key tablet switch group 101 to detect the ON/OFF state, touch response, or the like of key switches included in the group 101 and holds the information of the respective switches. The information is provided to a control circuit 103 which controls the system 100.

When supplied with the information from the key tablet assignor 102, the control circuit 103 sets a composite waveform in a main memory 110 on the basis of the following Fourier sysnthesis equation (1):

$$An = \sum_{q=1}^{W} Fq \cdot Cq \cdot \sin \frac{2\pi nq}{2W}, \; n = 1 \text{ to } 2W \qquad (1)$$

where q is the harmonic order n the sample point number, W the number of harmonics, Cq a q-order harmonic coefficient, Fq a q-order scaling coefficient, and Zn a sample value. The procedure for the above operation is as follows: A signal is applied from the control circuit 103 to a harmonic coefficient memory 108 to read out therefrom the harmonic coefficient Cq of a timbre desired to produce. On the other hand, ADSR data which is envelope information representing temporal variations of an envelope, touch response information representing initial and after touch response data, and timbre information representing a selected timbre are applied to a scaling value generator 105, from which is obtained a scaling value Fq for scaling the harmonic coefficient Cq, i.e. a value for its level control. The harmonic coefficient Cq and the scaling value Fq are multiplied in a multiplier 107, obtaining a harmonic coefficient Cq' scaled by the scaling value Fq. The harmonic coefficient Cq' thus obtained and a q-order sine wave value, $\sin_W \pi ng$, read out of a sine wave function table 104 with a signal from the control circuit 103 are multiplied in a muliplier 106. The multiplied value from the multiplied 106 is accumulated by an accumulator 109, by which the composite waveform expressed by Eq. (1) is created and stored in a main memory 110.

Next, the composite waveform thus stored in the main memory 110 is transferred via a transfer select circuit 111 to at least one of note memories 112-1 to 112-m (where m means the provision of plural note memories, but it is evident that they can be combined into one on a time-shared basis) corresponding to keys. The composite waveform thus stored in the note memory is read out therefrom, without exerting any influence upon the synthesization of a waveform, by note frequency data from a note frequency data generator 113 which generates note frequency data corresponding to a depressed key. Data read out of the note frequency memories 112-1 to 112-m corresponding to a scale is each multiplied, in one of multipliers 114-1 to 114-m, by the envelope output waveform from an envelope generator 115 which creates an envelope waveform corresponding to each depressed key, thus producing musical waveform data added with an envelope. The musical waveform data from the multipliers 114-1 to 114-m is converted by D/A converters 116-1 to 116-m into an analog musical waveform, which is applied to a sound system 117, creating a desired musical tone.

The gist of the invention proposed in the above-mentioned application now U.S. Pat. No. 4,700,603 resides in the scaling value generator 105. The scaling value generator 105 sets the harmonic order q, the cut-off harmonic order $q_c$, and the format filter level Ha necessary for forming the waveform, on the bases of the ADSR data, the touch response information, and the timbre information, thereby obtaining a desired formant filter characteristic.

FIG. 4 is a block diagram showing a specific operative example of the scaling value generator 105 which produces a low-pass or high-pass formant filter characteristic with resonance, and FIGS. 5A to 5D are explanatory of its operation. This is described in detail in the afore-mentioned application, and hence will be described in brief.

In FIG. 4 a subtractor 301-1 performs an operation $(q-q_c)$ and applies its output D to a complementor 302-2. The complementor 302-2 further receives, as a control input, an overflow signal Co from the subtractor 302-1 and converts the subtractor output D to an absolute value $|D|$, which will be used as an address signal for accessing a slope memory 301. This is shown in FIG. 5A. Assuming that the chain line ① in FIG. 5B indicates the stored content of the slope memory 301, the line ② in FIG. 5B will represent the value which is read out from the slope memory 301, using the output of the complementor 302-2 as an address signal. A level comparator 308 makes a comparison between the value A of the output ② from the slope memory 301 and the value B of an arbitrarily set filter level Ha ③, and provides the comparison result to a data selector 304 via a OR gate 307. On the other hand, the output from an order comparator 303 which compares the harmonic order q and the cut-off harmonic order $q_c$ is applied to the data selection 304 via a combination of an AND-OR gate 306 and a NOT gate 305 and via the OR gate 307. The operations of these combined gates will not be described in detail for the sake of brevity. The data selector 304 selects the value A or B in accordance with the value of the harmonic order q relative to the cut-off harmonic order $q_c$, produces a low-pass formant filter characteristic waveform shown in FIG. 5C or high-pass formant filter characteristic waveform shown in FIG. 5D, and yields the scaling value Fq corresponding to the harmonic order q. The scaling value Fq is multiplied, in the multiplier 107, by the harmonic coefficient Cq from the harmonic coefficient memory 108.

FIG. 6A shows a typical formant filter characteristic which is obtainable with the electronic musical instrument proposed in the afore-noted application. In FIG. 6A, reference character $q_c$ indicates a cut-off order which determines the cut-off position of the formant filter characteristic, Ha a level for providing the formant filter characteristic with resonsance, and SL the slope of the formant filter characteristic. The slope SL is stored in a memory. FIGS. 6B and 6C show, on an enlarged scale, the peak portion of the formant filter characteristic depicted in FIG. 6A. In FIG. 6B, the full line shows the current cut-off order $q_c$ on an enlarged scale. When the cut-off order changes from $q_c$ and $q_c'$, even if an address for reading out the slope memory is generated on the basis of the cut-off order expressed by an integer alone or an integer and a decimal, the cut-off ouder will undergo an abrupt change from $q_c$ to $q_c'$ as seen from a change from the full line to the broken line in FIG. 6B, in case the slope memory does not store data including the decimal part of the cut-off order.

Such an abrupt change of the cut-off order leads to the generation of a very jarring, temporarily-varying noise in the musical tone that will ultimately be produced. This problem could be solved by improving the resolution for slope data so that the cut-off harmonic order varies, little by little, from $q_c$ (indicated by the solid line), to $q_c'$ as indicated by the broken line in FIG. 6C. With such finer resolution, the temporarily-varying noise could be reduced. One possible method for obtaining greater resolution is to increase the capacity of the slope memory, but this is uneconomical. In order to raise the resolution by a precision of 3 to 4 bits, for example, the memory capacity myst be increased 8 to 16 times. The present inventor has succeeded in implementing this function by interpolating values stored in the slope memory, without increasing its capacity.

SUMMARY OF THE INVENTION

It is therefore an object of the present invention to provide an electronic musical instrument which is adapted to obtain greater resolution for slope data which is stored in the slope memory, without increasing the memory capacity.

To attain the above object, the electronic musical instrument of the present invention, which is of the type that combines harmonic components corresponding to respective harmonic orders into a desired musical waveform, the musical waveform having a formant filter characteristic with a harmonic order q, a cutoff harmonic order $q_c$ which is below or above the harmonic order, a level Ha, and a slope SL, is provided with means for generating the cut-off harmonic order $q_c$ which determines a cut-off of the formant filter characteristic respresenting the level of each harmonic component, the cut-off harmonic order $q_c$ being composed of integral and decimal parts, means for generating the level Ha of the formant filter characteristic, mwans which receives a slope coefficient for determining the slope of the formant filter characteristic, accumulates the slope coefficient, and extracts the accumulated value from the decimal part of the cut-off harmonic order $q_c$ to calculate the slope of the formant filter characteristic, means for storing the thus calculated slope of the formant filter, and select means for selecting one of the level Ha from the level generating means and the slope from the memory means in accordance with the integral part of the cut-off harmonic order $q_c$ from the cut-off harmonic order generating means.

With the above arrangement, decimal interpolation values are provided between the integral values of cut-off orders $q_c$ and $q_c'$, by which the level of the format filter characteristic varies in substantially the same manner as shown in FIG. 6C. This will raise the resolution, and hence will suppress the generation of noise.

DESCRIPTION OF THE PREFERRED EMBODIMENTS

Figure 1A:
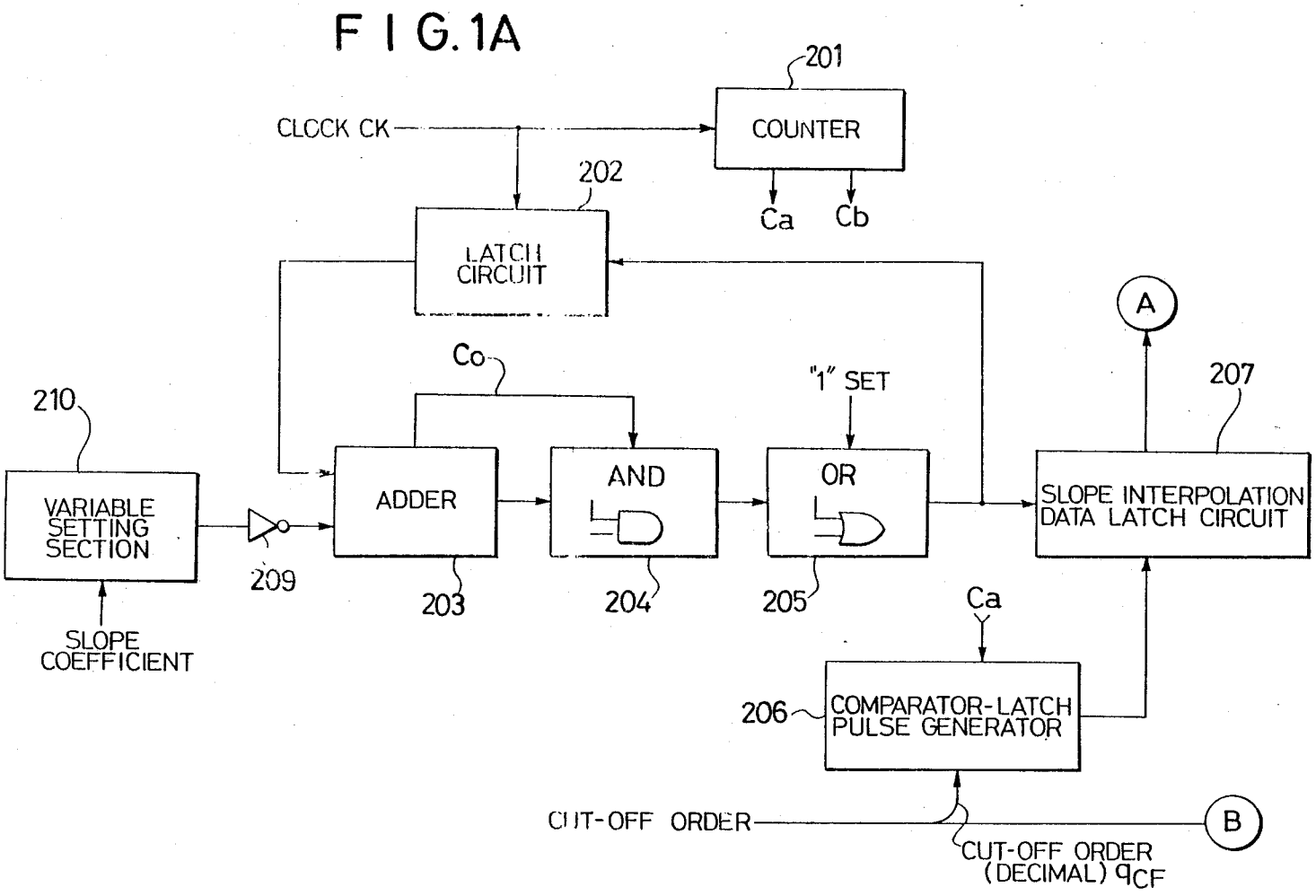
FIGS. 1A and 1B are a block diagram illustrating the arrangement of an embodiment of the present invention.
Figure 1B:
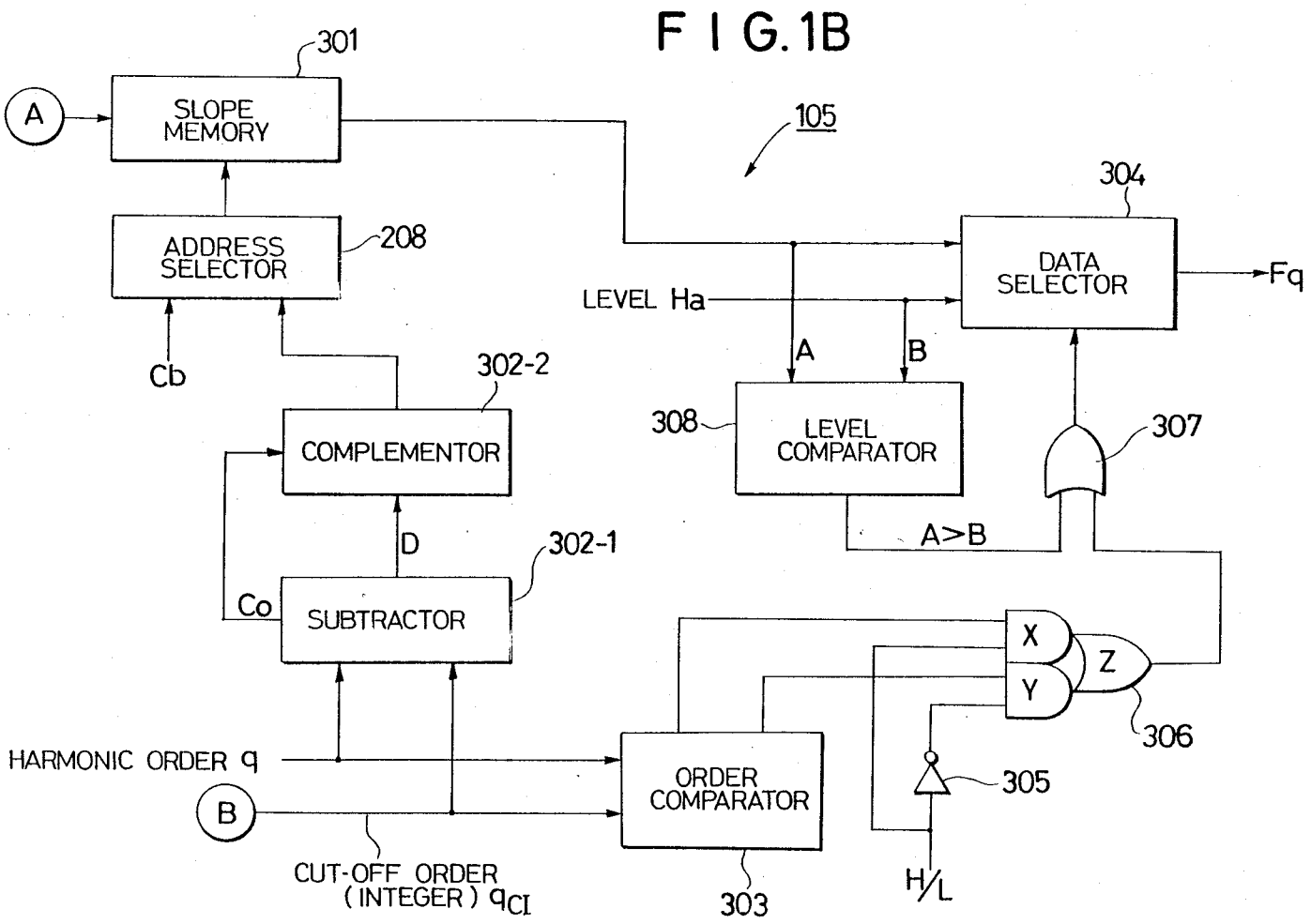
Figure 4:
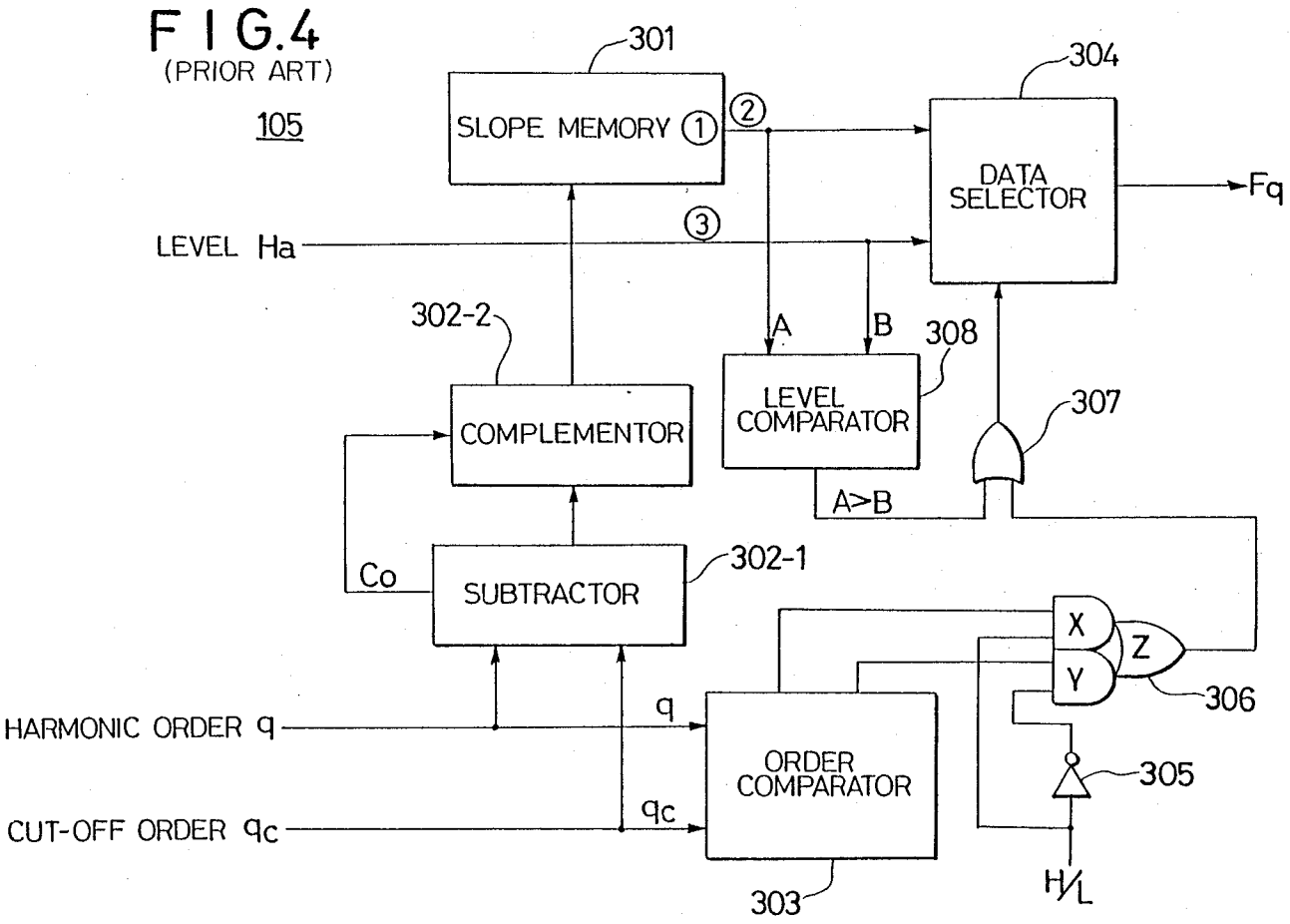
FIG.4 (PRIOR ART)
FIG. 4 is a block diagram illustrating the principal part of the example shown in FIGS. 3A and 3B.
Figure 5A:
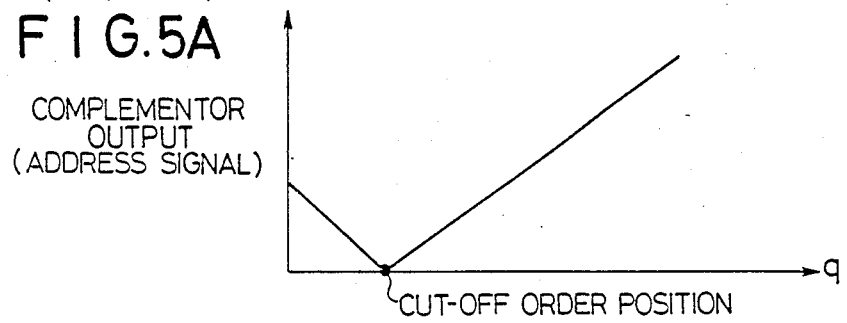
(PRIOR ART) FIG.5A
FIGS. 5A through 5D are graphs for explaining the operation of the example depicted in FIG. 4.
Figure 5B:
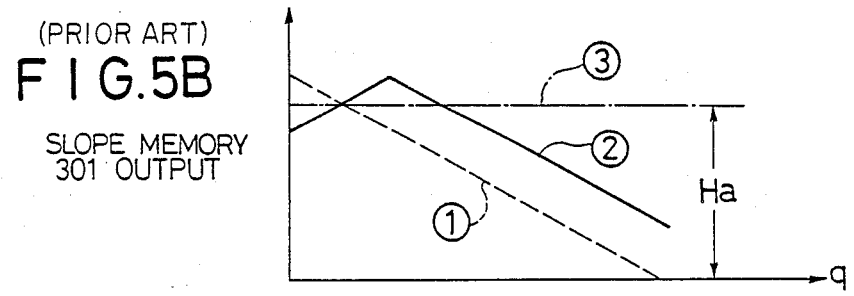
(PRIOR ART) FIG.5B
Figure 5C:
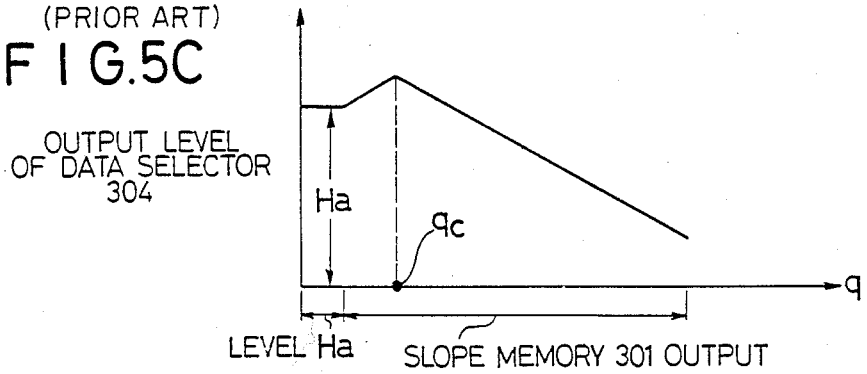
(PRIOR ART) FIG.5C
Figure 5D:
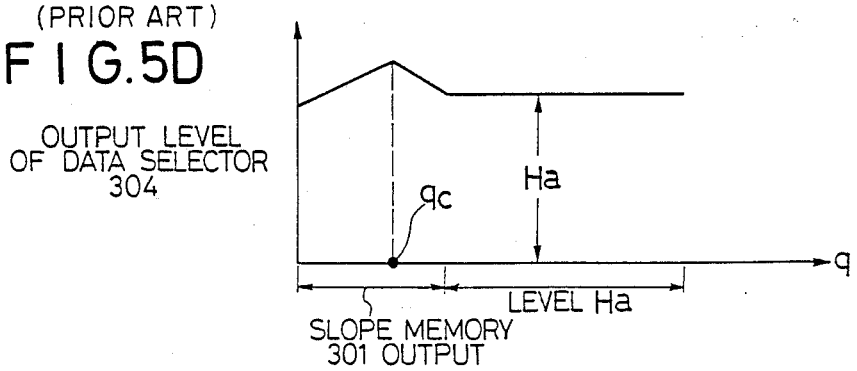
(PRIOR ART) FIG.5D
Figure 6A:
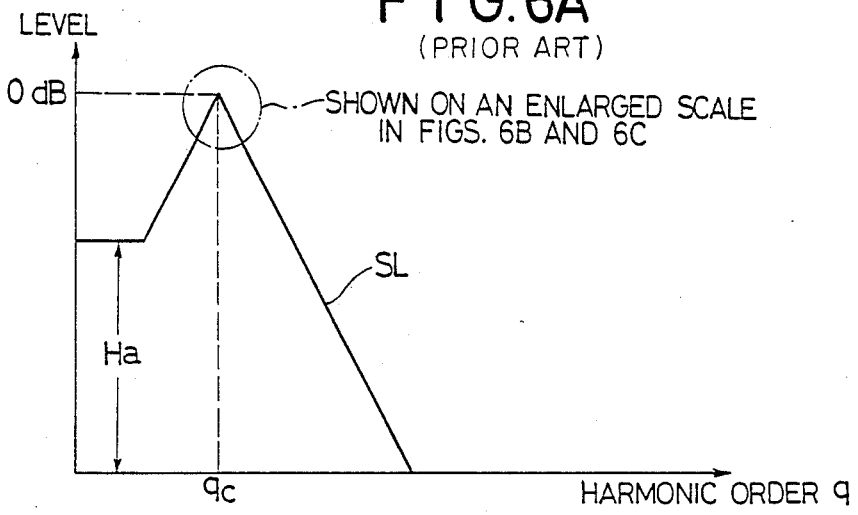
FIG. 6A (PRIOR ART)
FIGS. 6A through 6C are graphs for explaining a problem experienced in the prior application example.
Figure 6B:
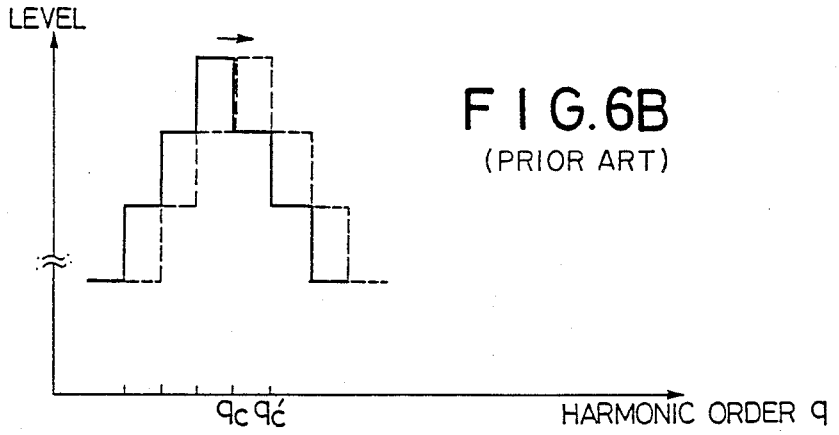
FIG. 6B (PRIOR ART)
Figure 6C:
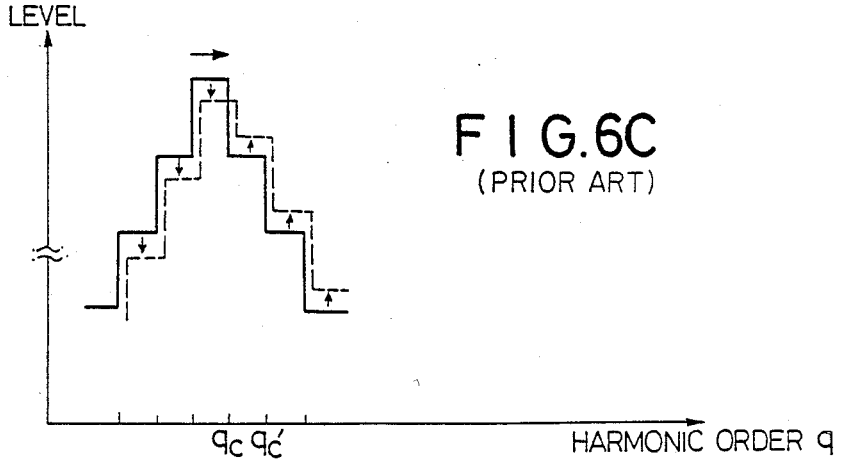
FIG. 6C (PRIOR ART)

FIGS. 1A and 1B illustrate in block form the arrangement of an embodiment of the present invention. In FIGS. 1A and 1B, the parts corresponding to those in FIG. 4 are identified by the same reference numerals and no detailed description will be given of them. In the present invention the cut-off harmonic order is composed of integral and decimal parts $q_{cI}$ and $q_{cF}$. An adder 203, an AND gate group 204, an OR gate group 205, and a latch circuit 202 constitute an accumulator (a subtractor), which accumulates, with a clock CK, the output from an inverter group 209 which inverts a slope coefficient.

At the beginning of the accumulation a set signal "" is applied to the OR gate group 205, setting all its outputs to "1s". The latch circuit 202 latches the outputs "1s", as first latch clocks, with the clock CK. Since the set signal "1" to the OR gate group 205 is cleared at this time, the OR gate group 205 passes therethrough the output from the AND gate group 205 to a slope interpolation data latch circuit 207. The 'all "1" state' latched first in the latch circuit 202 represent a maximum value (i.e., 0 dB) of the slope of the formant filter characteristic. By repeating a subtraction from the maximum value, values of the slope at respective points of time are provided from the adder 203. The AND gate group 204 is adapted so that where the slope value becomes minus below a minimum value (a "0"), it outputs a "0" as the minimum value on the basis of a carry-out signal Co from the adder 203. By the above operation there is obtained from the OR gate group 205 a value which gradually diminishes from the maximum value in units of the slope coefficient value. The output from the OR gate group 205 is held in the slope interpolation data latch circuit 207 with a pulse which is yielded by a comparator-latch pulse generator 206 when it detects coincidence between the decimal $q_{cF}$ of the cut-off harmonic order and the count value Ca of a counter 201 which represents the resolution of the slope corresponding to the cut-off harmonic order. The slope value thus held in the slope interpolation data latch circuit 207 is stored in the slope memory 301 for storing data which will be read out afterward for producing the slope SL for the formant filter characteristic. For writing the slope value in the slope memory 301, and output Cb from the counter 201 which indicates that the cut-off harmonic order is an integer is provided, as a write address, via an address selector 208 to the memory 301. For reading out the slope value from the slope memory 301, an address signal obtained on the bases of the harmonic coefficient q and the cut-off harmonic order (the integral part) $q_{cI}$ is applied, as a readout address, to the slope memory 301 from the complementor 302-2 via the address selector 208. In this way, there are stored in the slope memory 301 interpolation values corresponding to the cut-off harmonic order when its value includes a decimal, not an integer alone. Accordingly, the resolution for the varying cut-off harmonic order is high.

Figure 2A:
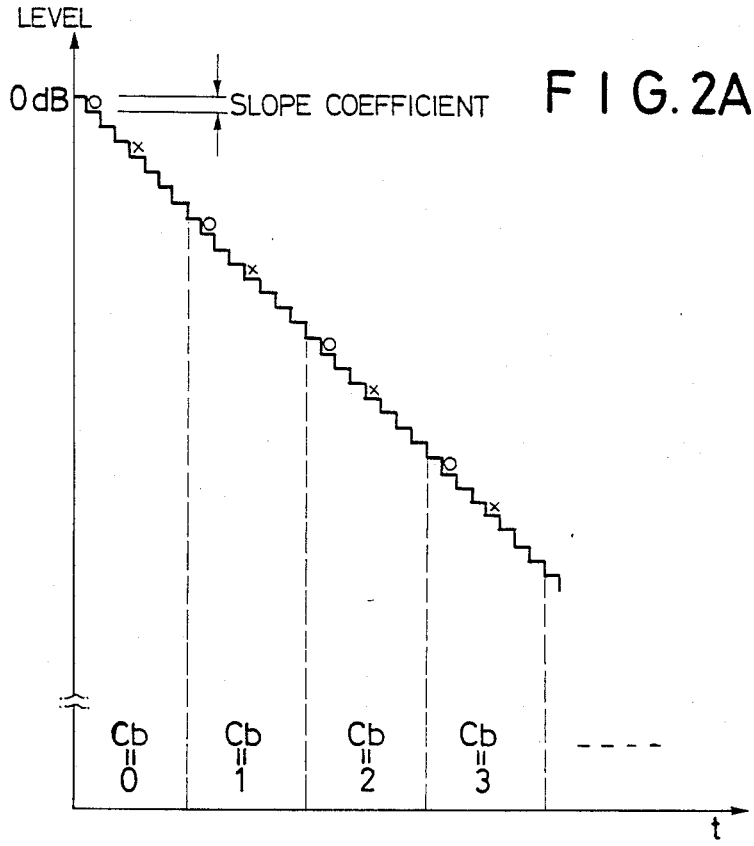
FIGS. 2A and 2B are graphs for explaining the operation of the embodiment depicted in FIGS. 1A and 1B.

FIG. 2A a graph showing the values which are provided from the OR gate group 205. It appears from FIG. 2A that the amplitude value diminishes gradually from the maximum value 0 dB by the slope coefficient at a time. In the case of FIG. 2A, since the resolution is shown to have eight steps, the output Ca from the counter 201 has three bits, but the number of bits may be selected as desired. As the integral part, Cb =0, 1, 2, 3, . . . Circles and crosses in FIG. 2A indicate the positions of data which is held in the slope interpolation data latch circuit 207 and stored in the slope memory 301 when the decimal part of the cut-off order is 0.001 and 0.100.

Figure 2B:
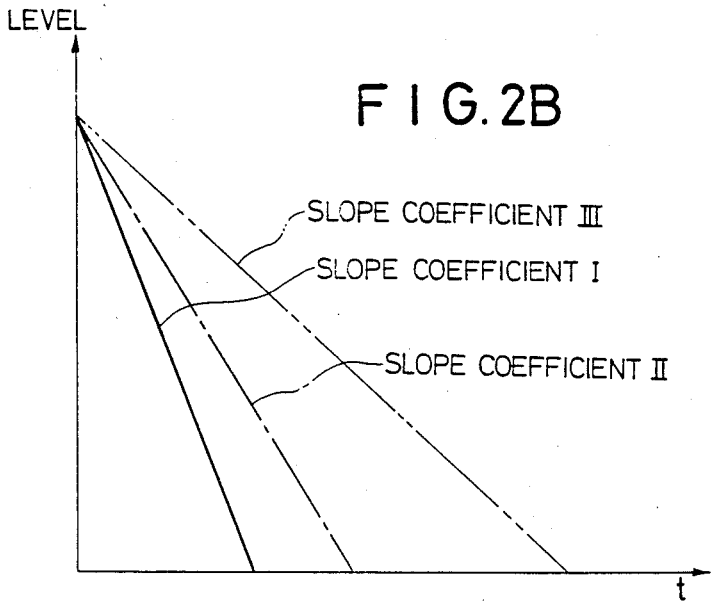
Figure 3A:
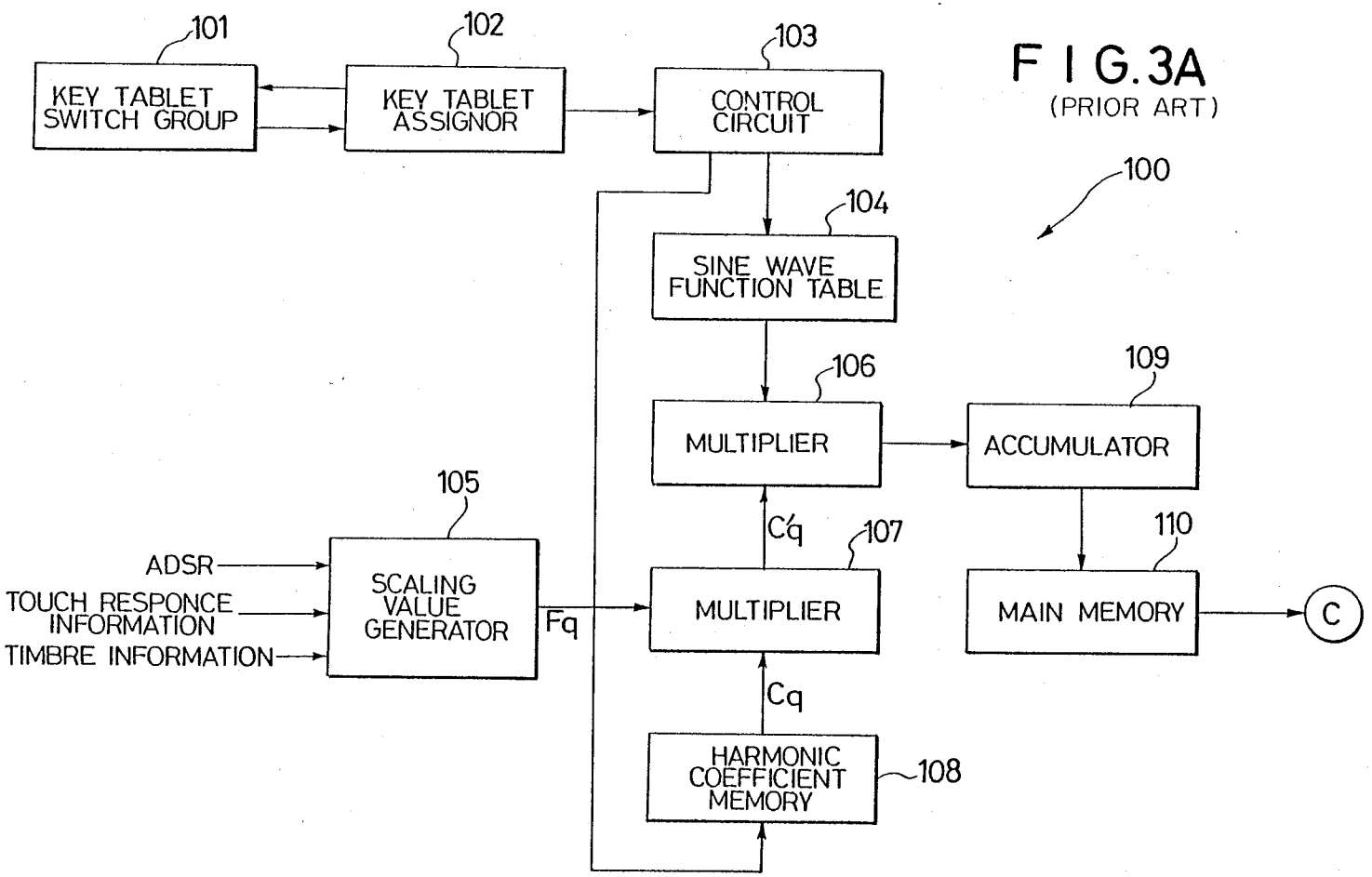
FIG. 3A (PRIOR ART)
FIGS. 3A and 3B are a block diagram illustrating the arrangement of a prior application example.
Figure 3B:
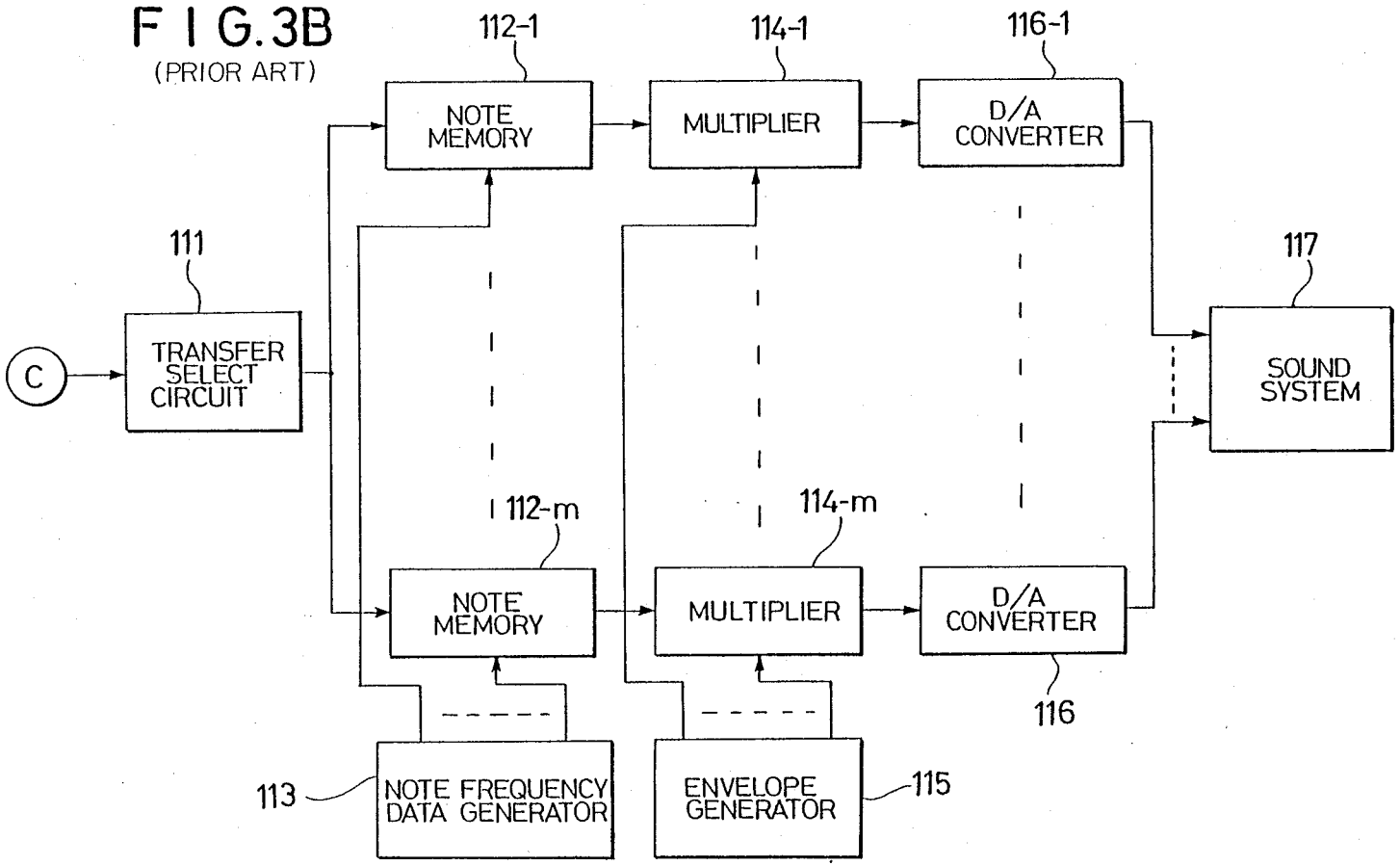
FIG. 3B (PRIOR ART)

FIG. 2B shows that different slopes can easily be obtained by changing the slope coefficient which is applied to the inverter 209, with a variable setting section 210. In other words, a desired formant filter characteristic can be obtained without the necessity of an address modifying device needed in the invention disclosed in the afore-mentioned United States patent application.

By interpolating integral values of individual cut-off harmonic orders with their decimal values, it is possible to obtain finer resolution and hence produce a smooth formant filter characteristic. As described above, according to the present invention, the integral values of the respective cut-off harmonic orders are interpolated for greater resolution, by which it is possible to prevent that slope data of the formant filter characteristic with resonance undergoes an abrupt change owing to a direct change in the cut-off harmonic order from $q_c$ to $q_c'$. Accordingly, the generation of noise can also be suppressed.

It will be apparent that many modifications and variations may be effected without departing from the scope of the novel concepts of the present invention.

What is claimed is:

1. An electronic musical instrument which combines harmonic components corresponding to respective harmonic orders into a desired musical waveform, the desired musical waveform having a formant filter characteristic with a harmonic order (q), a cut-off harmonic order ($q_c$) which is below or above the harmonic order, a level (Ha), and a slope (SL), comprising:

cut-off harmonic order ($q_c$) variable setting means for generating the cut-off harmonic order ($q_c$) which determines a cut-off position of the formant filter characteristic sacling the level of each harmonic component, the cut-off harmonic order ($q_c$) being composed of an integral and a decimal part, level generating means for generating the level (Ha) of the formant filter characteristic;

slope coefficient generating means for generating a slope coefficient which determines the slope of the formant filter characteristic;

slope calculating means for receiving the generator slope coefficient, for accumulating the generated slope coefficient and for extracting the accumulated value from the decimal part of the cut-off harmonic order ($q_c$), for calculating the slope (SL) of the formant filter characteristic;

memory means for storing the calculated slope (SL), as the slope (SL) of the formant filter characteristic, at an address in the memory means;

means for generating an address for reading out the slope (SL) from the memory means on the basis of the integral part of the cut-off harmonic order ($q_c$) and the harmonic order (q);

select means for selecting one of the level (Ha) from the level generating means and the slope (SL) from the memory means in accordance with the integral part of the cut-off harmonic order ($q_c$), the select means generating a formant filter characteristic signal therefrom; and means for using the formant filter characteristic signal to control each harmonic component value.

2. The electronic musical instrument of claim 1, wherein the slope coefficient generating means includes: slope coefficient variably setting means whereby the slope coefficient for input into the slope (SL) calculating means is set variably thereby obtaining from the select means the formant filter characteristic of varied slope.

3. The electronic musical instrument of claim 2, wherein the slope coefficient variably setting means includes: envelope generating means for generating an envelope the output amplitude of which varies with time after depression of a key; a touch response information generator which detects the speed of the key depression and generates touch response information in accordance with the detected speed; a tone information generator for generating tone information of a tone selected as desired; and, means for varying the slope coefficient in accordance with the envelope information from the envelope generator, the touch response information from the touch response information generator and the tone information from the tone information generator.

4. The electronic musical instrument of claim 1, wherein the select means includes means whereby the output signal from the select means is provided with a high-pass formant filter characterisitc or low-pass formant filter characteristic.

5. The electronic musical instrument of claim 1, wherein the cut-off harmonic order ($q_c$) generating means includes variable setting means for variably setting the cut-off harmonic order ($q_c$), thereby obtaining from the select means the formant filter characteristic of a vaired cut-off position.

6. The electronic musical instrument of claim 5, wherein the cut-off harmonic order ($q_c$) variable setting means includes: an envelope generator for generating an envelope the output amplitude of which varies with time after the depression of a key; a touch response information generator which detects the speed of a key depression and generates touch response information corresponding to the detected speed; tone information generator for generating tone information of a tone selected as desired; and means for varying the cut-off harmonic order ($q_c$) in accordance with the envelope information from the envelope generator, the touch response information from the touch response information generator when the tone information from the tone information.

7. The electronic musical instrument of claim 1, wherein the level (Ha) generating means includes variable setting means for varying the level (Ha), thereby obtaining from the select means the formant filter characteristic of a varied level.

8. The electronic musical instrument of claim 7, wherein the level (Ha) variable setting means includes: an envelope generator for generating an envelope the output amplitude of which varies with time after depression of a key; a touch response information generator which detects the speed of a key depression and generates touch response information in accordance with the detected speed; tone information generator for generating tone information of a tone selected as desired; and means for varying the level (Ha) in accordance with the envelope information from the envelope generator, the touch response information from the touch response information generator and the tone information of the tone information generator.

* * * * *